US005337659A

United States Patent [19]

Whelan

[11] Patent Number: 5,337,659

[45] Date of Patent: Aug. 16, 1994

[54] APPARATUS AND METHOD UTILIZING CONTINUOUS MOTION OFFSET AND DIRECT PRINTING TECHNIQUES FOR DECORATING CYLINDRICAL CONTAINERS

[75] Inventor: Edward J. Whelan, Hasbrouck Heights, N.J.

[73] Assignee: Sequa Corporation, New York, N.Y.

[21] Appl. No.: 20,365

[22] Filed: Feb. 22, 1993

[51] Int. Cl.[5] ..... B41F 17/22

[52] U.S. Cl. ..... 101/40; 101/76; 101/217

[58] Field of Search ..... 101/38.1, 39, 40, 40.1, 101/212, 217, 490, 492, 76, 77, DIG. 39, 111, 247

[56] References Cited

U.S. PATENT DOCUMENTS

| | | | |
|---|---|---|---|
| 4,538,513 | 9/1985 | Sedlak et al. | 101/247 |
| 4,884,504 | 12/1989 | Sillars | 101/38.1 |
| 4,893,559 | 1/1990 | Sillars | 101/40.1 |
| 4,921,093 | 5/1990 | Peters et al. | 101/40 |
| 5,181,471 | 1/1993 | Sillars | 101/217 |

*Primary Examiner*—Edgar S. Burr
*Assistant Examiner*—Stephen R. Funk
*Attorney, Agent, or Firm*—Mitchell D. Bittman; Jerry Berliner

[57] ABSTRACT

Continuous motion apparatus having an offset blanket wheel for applying main images to cylindrical containers is also provided with a plurality of direct printing units that apply auxiliary images to the containers. All of the cassettes are mounted on the blanket wheel. Each cassette is provided with at least one belt having a plurality of auxiliary images in tandem. The belt or belts, as the case may be, is driven continuously at uniform speed along a closed loop path. The cylindrical outer surface having images applied thereto travels at the same linear speed as the offset blanket, and there is a difference in linear speeds between the belt with the auxiliary images thereon and the cylindrical outer surface, even while the auxiliary images are being applied to the cylindrical outer surface.

13 Claims, 9 Drawing Sheets

21a
43a
8
85
84
83
75
74
73
72
82
81
71
142
141
46
88
7
9
40
80
66
67
47
78
77
21b
43b 32a
71
72
B
97
31a
96
B
31b
94
21a
95
43a
72
71
73
74
75
89
45
43b
40
87
21b
91
A
91
20
16

APPARATUS AND METHOD UTILIZING CONTINUOUS MOTION OFFSET AND DIRECT PRINTING TECHNIQUES FOR DECORATING CYLINDRICAL CONTAINERS

BACKGROUND OF THE INVENTION

This invention relates to high speed continuous motion can decorators and more particularly relates to a can decorator of the type which, in addition to utilizing offset means for printing a main image, provides auxiliary image printing plates that make direct engagement with the can.

U.S. Pat. No. 4,921,093 issued May 1, 1990 to A. Peters et al. entitled Infeed Means for High Speed Continuous Motion Can Decorator discloses high speed continuous motion can decorating apparatus that utilizes offset printing techniques for decorating all cans with the same indicia. Other examples of continuous motion high speed can decorators of this type are also disclosed in U.S. Pat. Nos. 3,563,170, 3,766,851 and 3,976,187.

In accordance with the instant invention, the device of the '093 patent is modified by adding a plurality of direct printing units, the latter having print indicia that is changed for each revolution of a continuously rotating blanket wheel that carries the cans through a printing zone where both main images (printed by offset blanket segments) and auxiliary images (printed by the direct printing units) are applied thereto. In a broad sense this type of arrangement is disclosed by U.S. Pat. No. 5,181,471 issued Jan. 26, 1993 to I. Sillars for Combined Offset and Flexographic Printing and Decorating System, U. S. Pat. No. 4,884,504 issued Dec. 5, 1989 to I. Sillars for a Method for Printing of Quasi-Random Number Tables on Cylindrical Objects and U.S. Pat. No. 5,265,532 issued Nov. 30, 1993, entitled Apparatus and Method for Decorating Cylindrical Containers, and assigned to the assignee of the instant invention. The combination of offset and direct printing on a single object is also disclosed in U.S. Pat. No. 2,660,111 issued Nov. 24, 1953 to W. Herrick et al. for a Postage Printing Device Using Direct and Offset Printing.

The disclosures of the aforesaid U.S. Pat. Nos. 5,181,471, 4,884,504 and 2,660,111 as well as the aforesaid U.S. Pat. No. 5,265,532 are incorporated herein by reference.

SUMMARY OF THE INVENTION

In prior art apparatus that utilizes a continuously rotating offset printing blanket wheel and direct printing units wherein successive images printed by the latter change for each revolution of the blanket wheel, the printing plates of the direct printing units or cassettes are mounted on a belt that is stepped (moved intermittently) along a closed loop path. It is not unusual for modern high speed decorators of the type under consideration to be operated at two thousand objects per minute. At such high speeds, the intermittently driven printing plate belts as well as the intermittent motion drives for such belts are subjected to undue mechanical strains.

To reduce the likelihood of breakdown and to increase those intervals required between servicing, pursuant to the instant invention the printing plate belts are driven at a continuous uniform speed. In fact, during direct printing of the auxiliary images the printing plate belts move relative to the cylindrical surface being printed on. However, this relative motion or slippage is so slight that any degradation of printing quality is not noticeable to the eye.

Accordingly, the primary object of the instant invention is to provide an improved continuous motion apparatus for decorating cylindrical containers and other cylindrical objects by utilizing offset printing techniques to apply a main image and direct printing techniques to apply an auxiliary image.

Another object is to provide apparatus of this type constructed so that there are direct printing units that have printing plate belts which move continuously at uniform speed relative to the continuously rotating offset printing blanket wheel.

Still another object is to provide a novel method for decorating cylindrical objects by utilizing a combination of offset and direct printing techniques.

A further object is to provide a method of this type in which the container is positively rotated about its own axis during direct printing thereon at the same speed used for offset printing thereon, while there is a differential speed between the direct printing plate and container surface being decorated by the direct printing plate.

BRIEF DESCRIPTION OF THE DRAWINGS

The foregoing objects as well as other objects of this invention shall become readily apparent after reading the following description of the accompanying drawings in which.

DETAILED DESCRIPTION OF THE DRAWINGS

Figure 1:
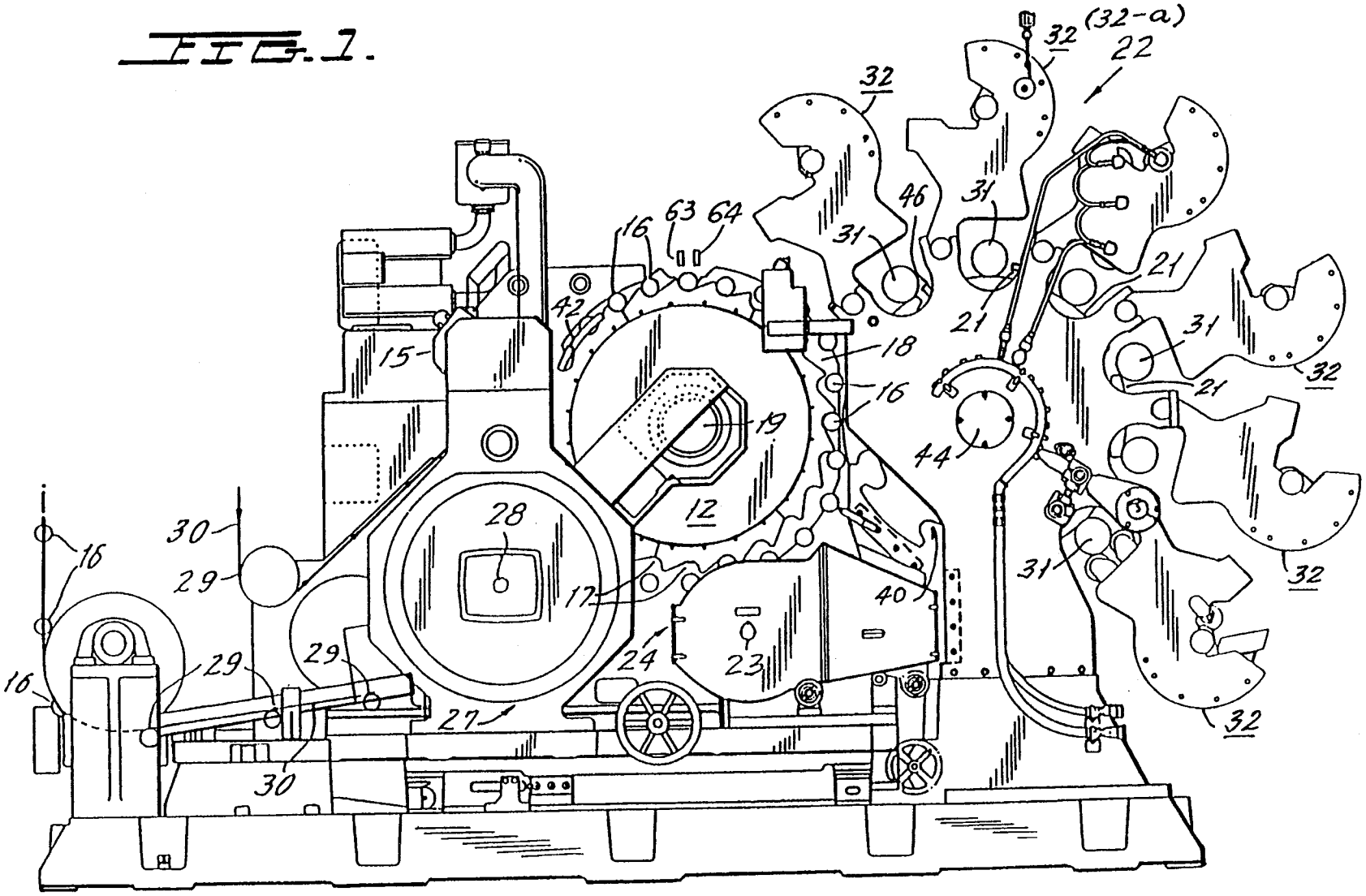
FIG. 1 is a front elevation of continuous motion can decorating apparatus constructed in accordance with teachings of the instant invention.

Now referring to the Figures and more particularly to FIG. 1 which illustrates continuous motion cylindrical container decorating apparatus of the general type described in U.S. Pat. No. 4,140,053 issued Feb. 20, 1979 to J. P. Skrypek et al. for a Mandrel Mounting and Trip Mechanism for Continuous Motion Decorator, as well as in the aforesaid U.S. Pat. No. 4,921,093 issued May 1, 1990 to A. Peters et al. The disclosures of both of these patents are incorporated herein by reference.

Briefly, the apparatus of FIG. 1 includes infeed conveyor 15 which receives cans 16, each open at one end, from a can supply (not shown) and directs them to arcuate cradles or pockets 17 along the periphery of spaced parallel rings secured to pocket wheel 12. The latter is fixedly secured to continuously rotating mandrel carrier wheel 18 which in turn is keyed to continuously rotating horizontal drive shaft 19. Horizontal spindles or mandrels 20 (FIG. 10) each rotatable about its own cylindrical axis, are mounted to wheel 18 adjacent its periphery. As is well-known to the art, in a short region extending downstream from infeed conveyor 15, each spindle or mandrel 20 is in closely spaced axial alignment with an individual pocket 17, and undecorated cans 16 are transferred from pockets 17 to mandrels 20 by wiping against stationary arm 42 which is angled inwardly in the downstream direction so as to function as a cam that drives can 16 horizontally (axially) toward mandrel 20. Suction applied through an axial passage of mandrel 20 draws cans 16 to final seating position on mandrel 20.

While mounted on mandrels 20, cans 16 are decorated by being brought into engagement with one of the image transfer mats or blanket segments 21 (21*a*, 21*b*, etc.) of the multicolor printing unit indicated generally by reference numeral 22. Thereafter, and while still mounted on mandrels 20, the outside of each decorated can 16 is coated with a protective film of varnish applied by engagement with the periphery of an applicating roll (not shown) rotating on shaft 23 in the overvarnish unit indicated generally by reference numeral 24. Cans 16 with decorations and protective coatings thereon are then transferred from mandrels 20 to suction cups (not shown) mounted adjacent the periphery of a transfer wheel (not shown) rotating on shaft 28 of transfer unit 27. From transfer unit 27 cans 16 are deposited on generally horizontal pins 29 carried by chain-type output conveyor 30 which carries cans 16 through a curing oven (not shown).

While moving toward engagement with an undecorated can 16, each blanket segment 21 engages a plurality of printing cylinders 31 each of which is associated with an individual inker unit 32. In a manner known to the art, each of the inker units 32 includes a plurality of ductor elements that produce a controlled film of ink which is applied to a printing cylinder 31. Each unit 32 provides a different color ink and each printing cylinder 31 applies a different image segment to blanket segments 21. All of these image segments combine to produce the same main image on each blanket segment 21, which main image is transferred to undecorated cans 16 in a printing region that commences slightly counterclockwise of the most counterclockwise printing cylinder 31.

Figure 5:
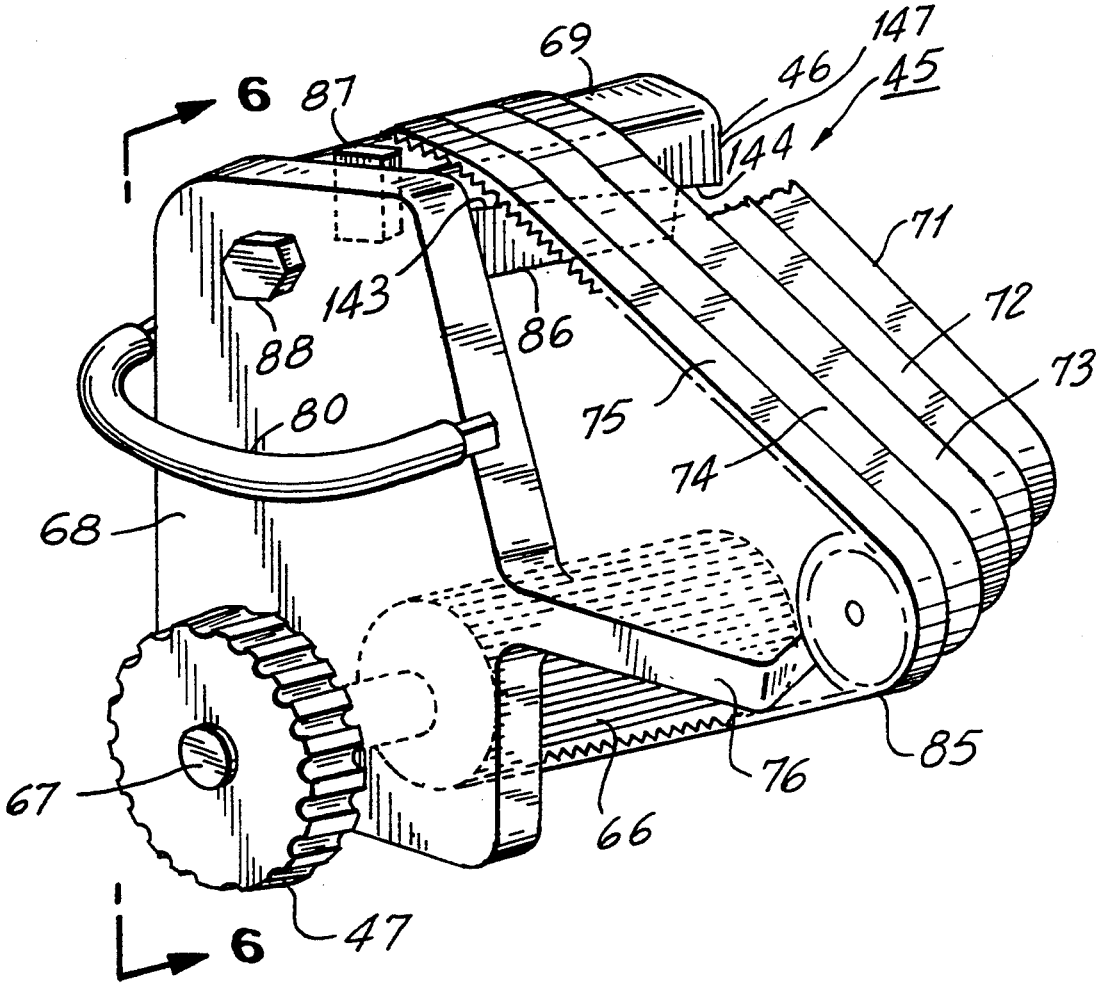
FIG. 5 is a simplified perspective of a continuous motion direct printing cassette constructed in accordance with teachings of the instant invention.
Figures 6, 9:
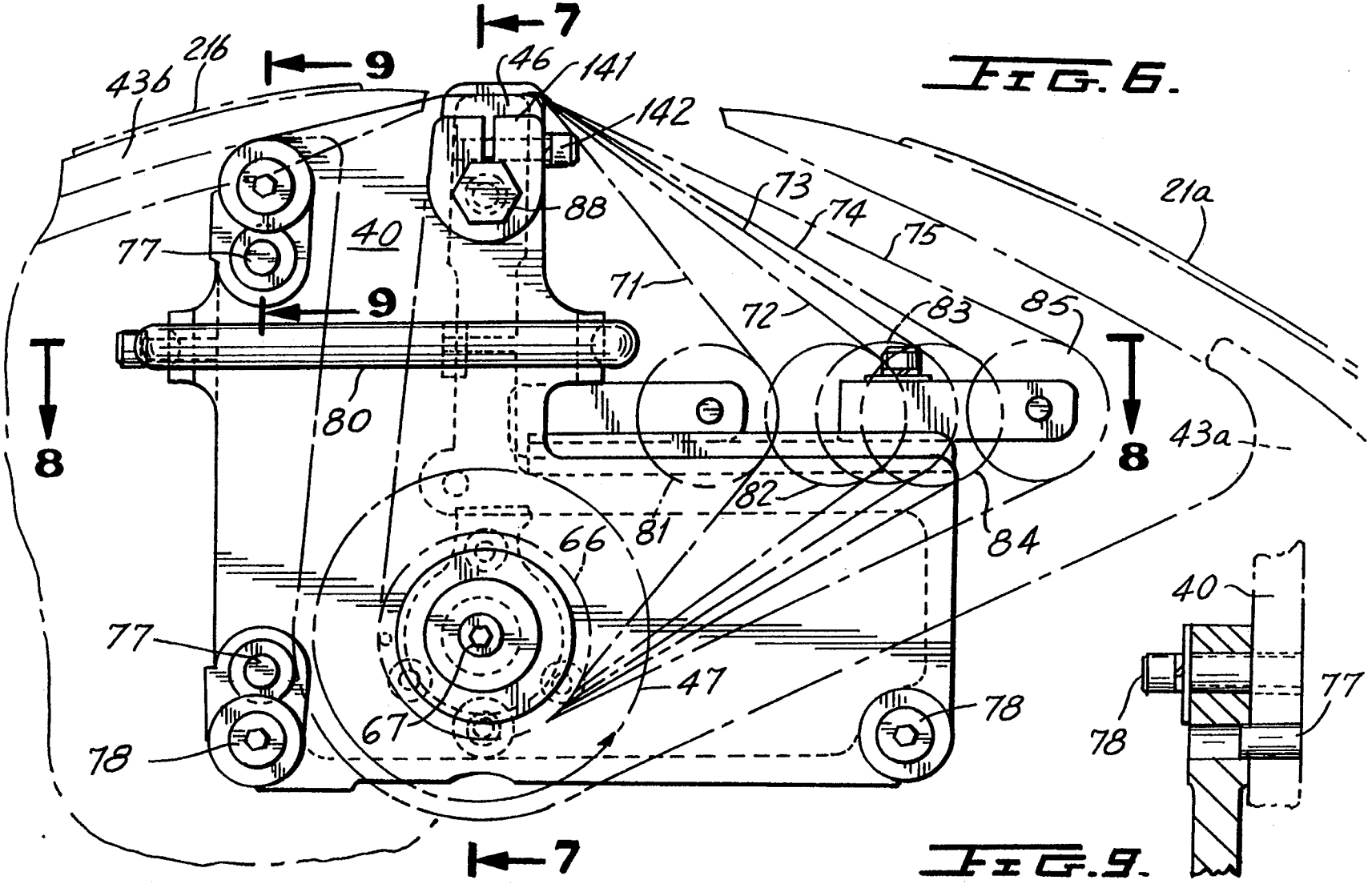
FIG. 6 is a side elevation of the continuous motion direct printing cassette looking in the direction of arrows 6—6 in FIG. 5.
FIG. 9 is a cross-section through line 9—9 of FIG. 6 looking in the direction of arrows 9—9.
Figure 7:
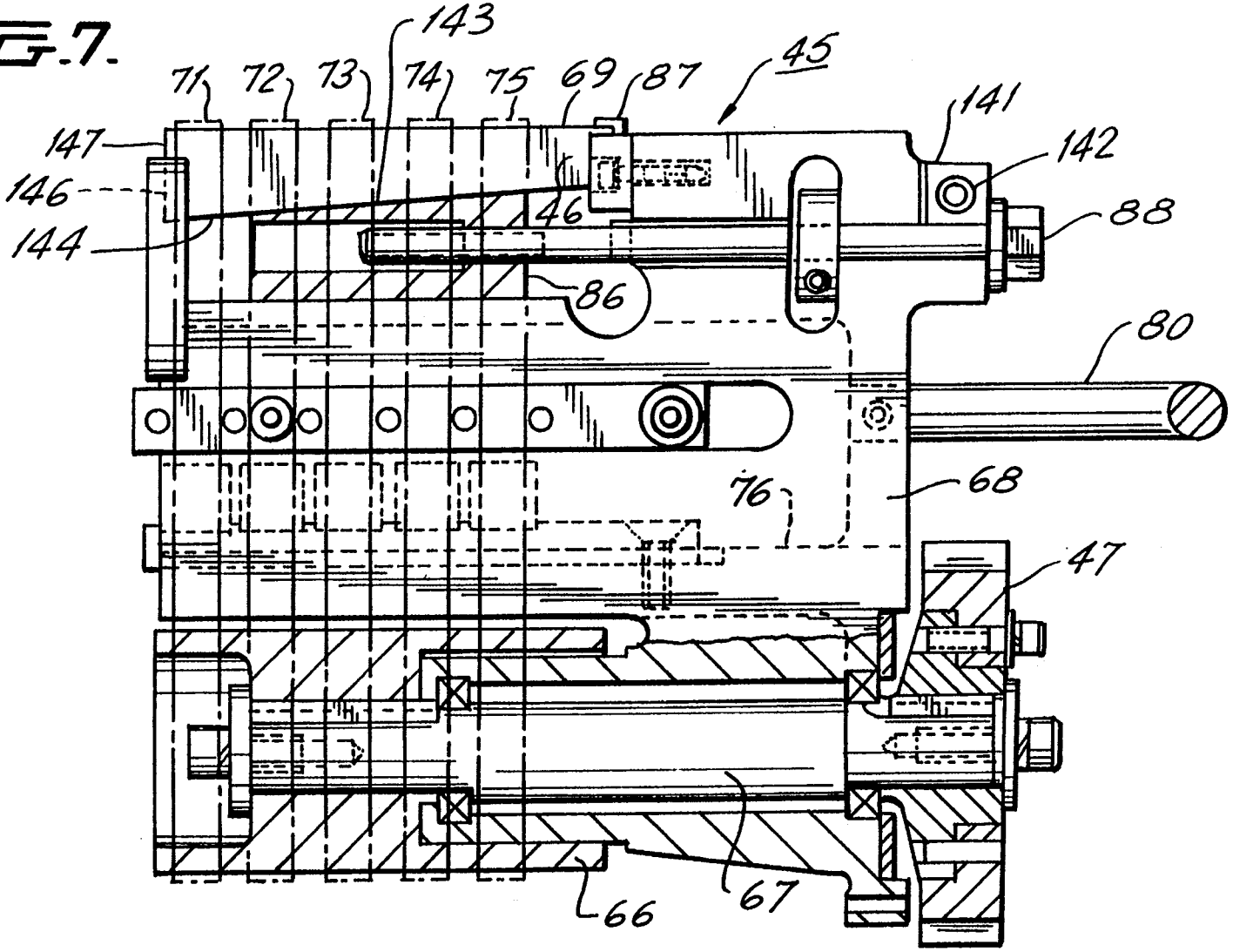
FIG. 7 is a cross-section taken through line 7—7 of FIG. 6 looking in the direction of arrows 7—7.
Figure 8:
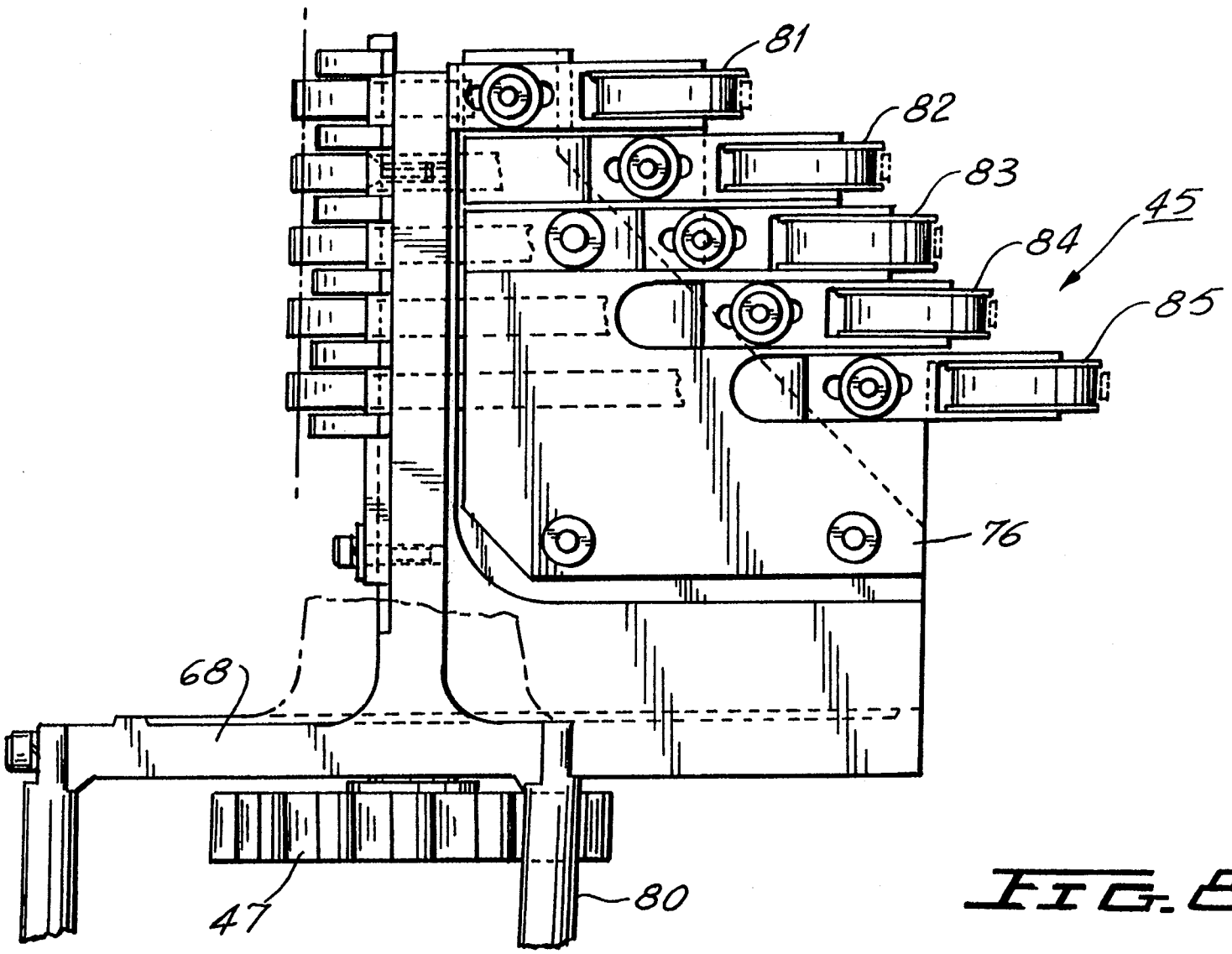
FIG. 8 is a cross-section taken through line 8—8 of FIG. 6 looking in the direction of arrows 8—8.
Figures 10, 11:
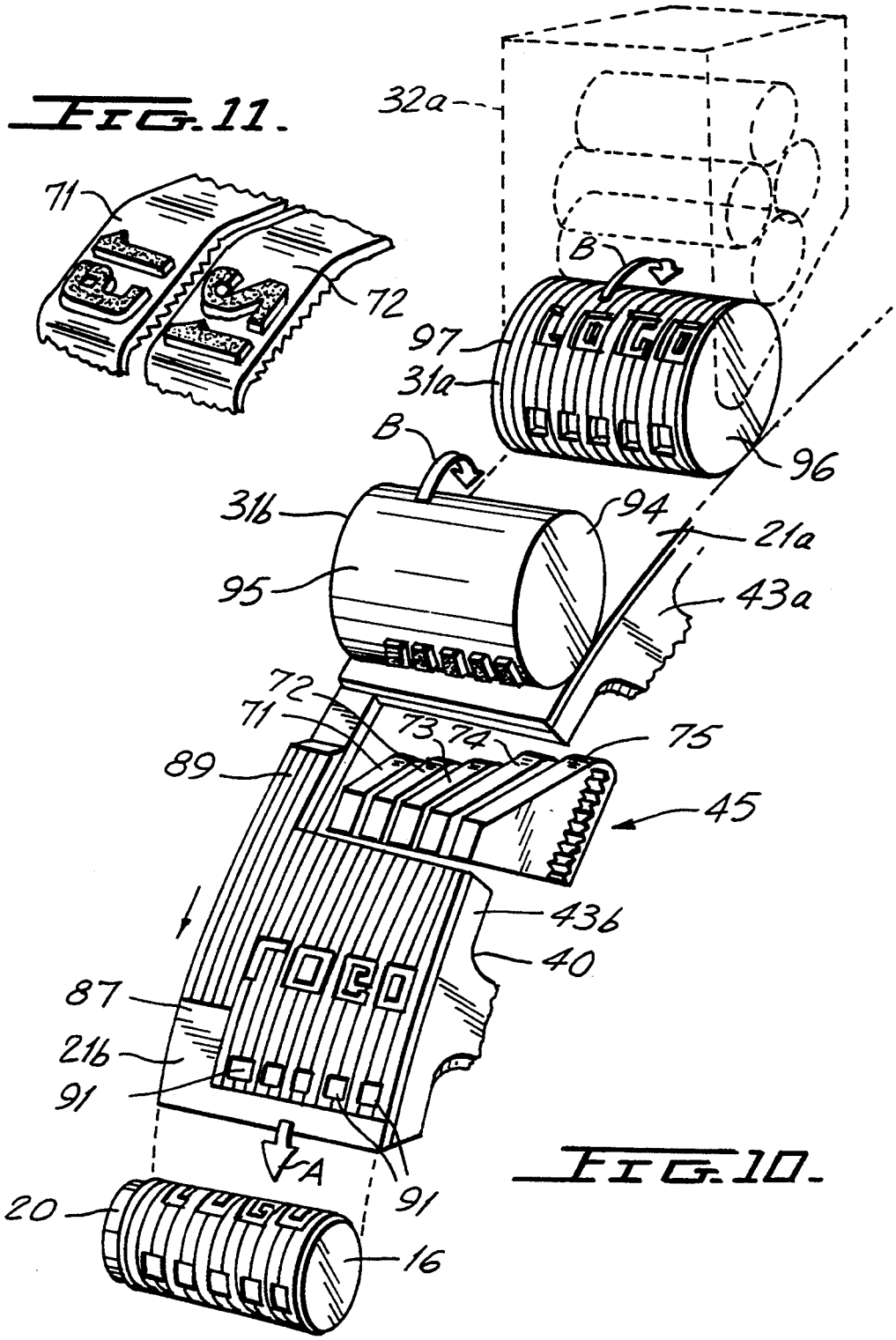
FIG. 10 is a simplified diagram, in perspective, illustrating the inking and printing operations in accordance with the instant invention.
FIG. 11 is an enlarged fragmentary portion of FIG. 10.

As seen in FIG. 10, each of the blanket segments 21 (21*a*, 21*b*, etc.) is cemented to an individual segment 43 (43*a*, 43*b*, etc.) along the periphery of generally hollow blanket wheel 40 that rotates continuously about its central axis that coincides with continuously driven shaft 44 to which blanket wheel 40 is keyed. Associated with each wheel segment 43 (43*a*, 43*b*, . . . ) and removably mounted to blanket wheel 40 is an individual direct printing unit or cassette 45 that includes anvil 46 disposed in a cutout at the upstream end of segment 43. Anvil 46 is provided with an outboard belt support surface 69 (FIG. 5) that is generally in curved alignment with blanket segment 21.

Figure 2:
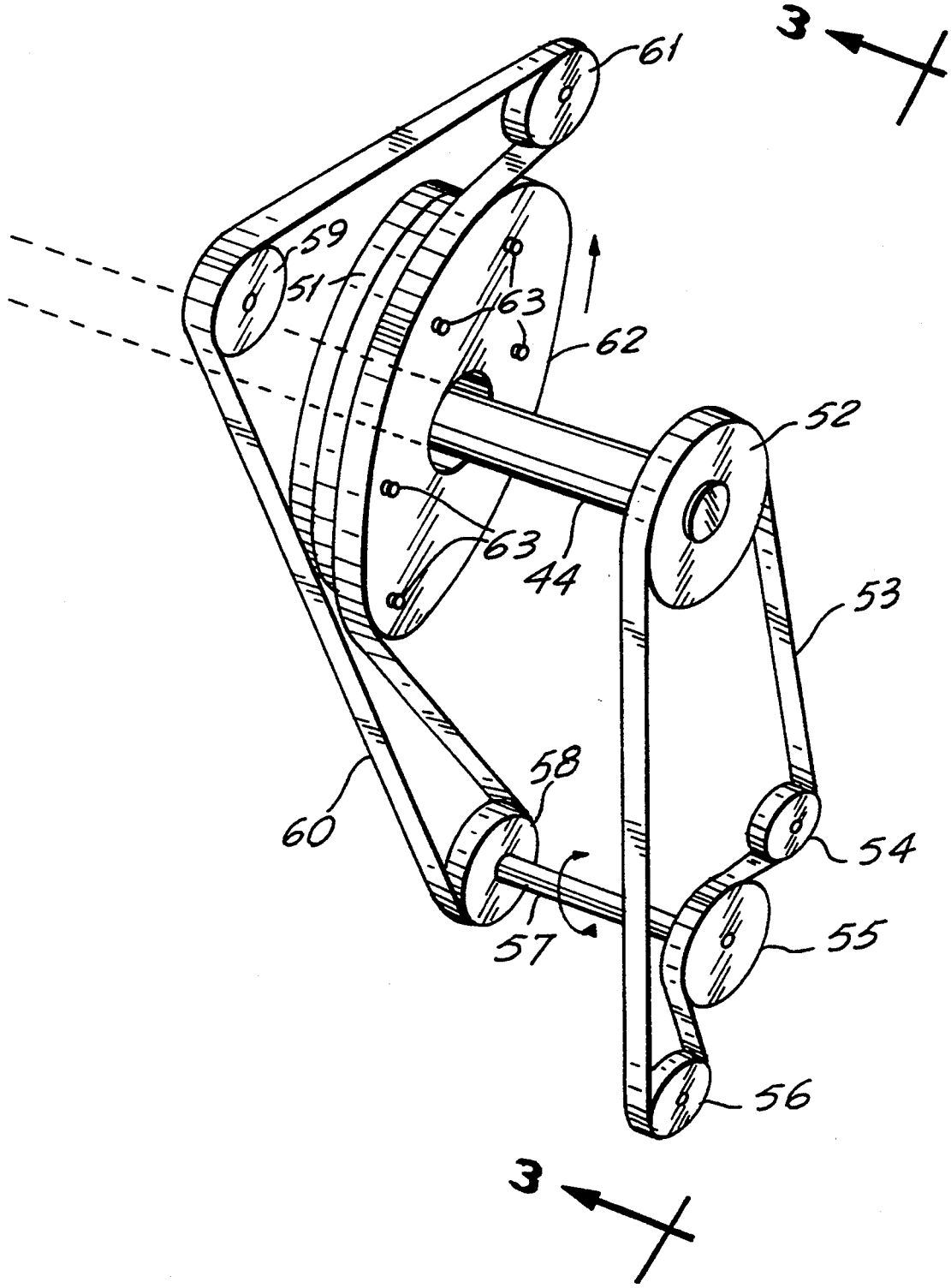
FIG. 2 is a simplified perspective illustrating the common drive for all of the direct printing cassettes in the apparatus of FIG. 1.
Figure 3:
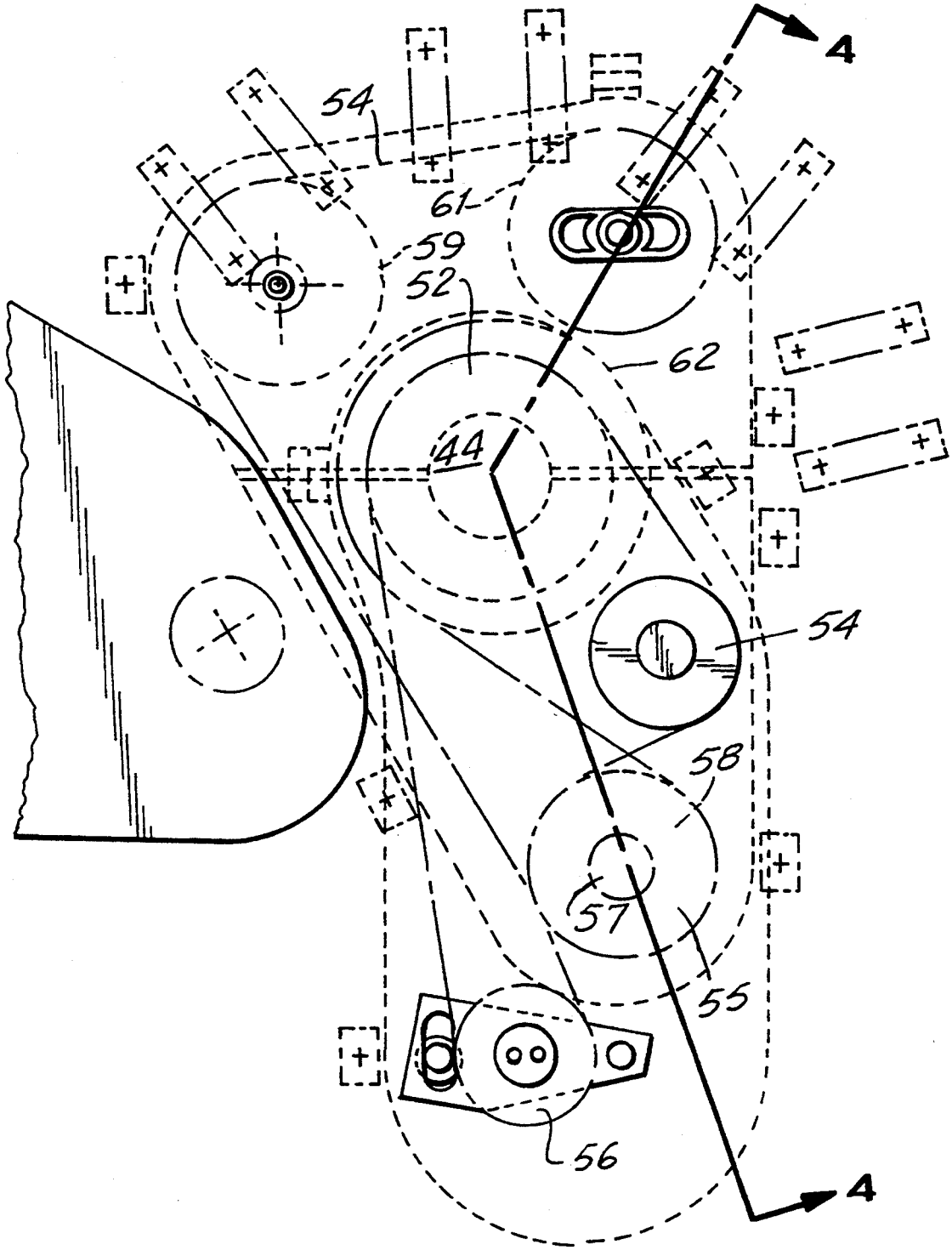
FIG. 3 is a side elevation of the common drive looking in the direction of arrows 3—3 in FIG. 2.
Figure 4:
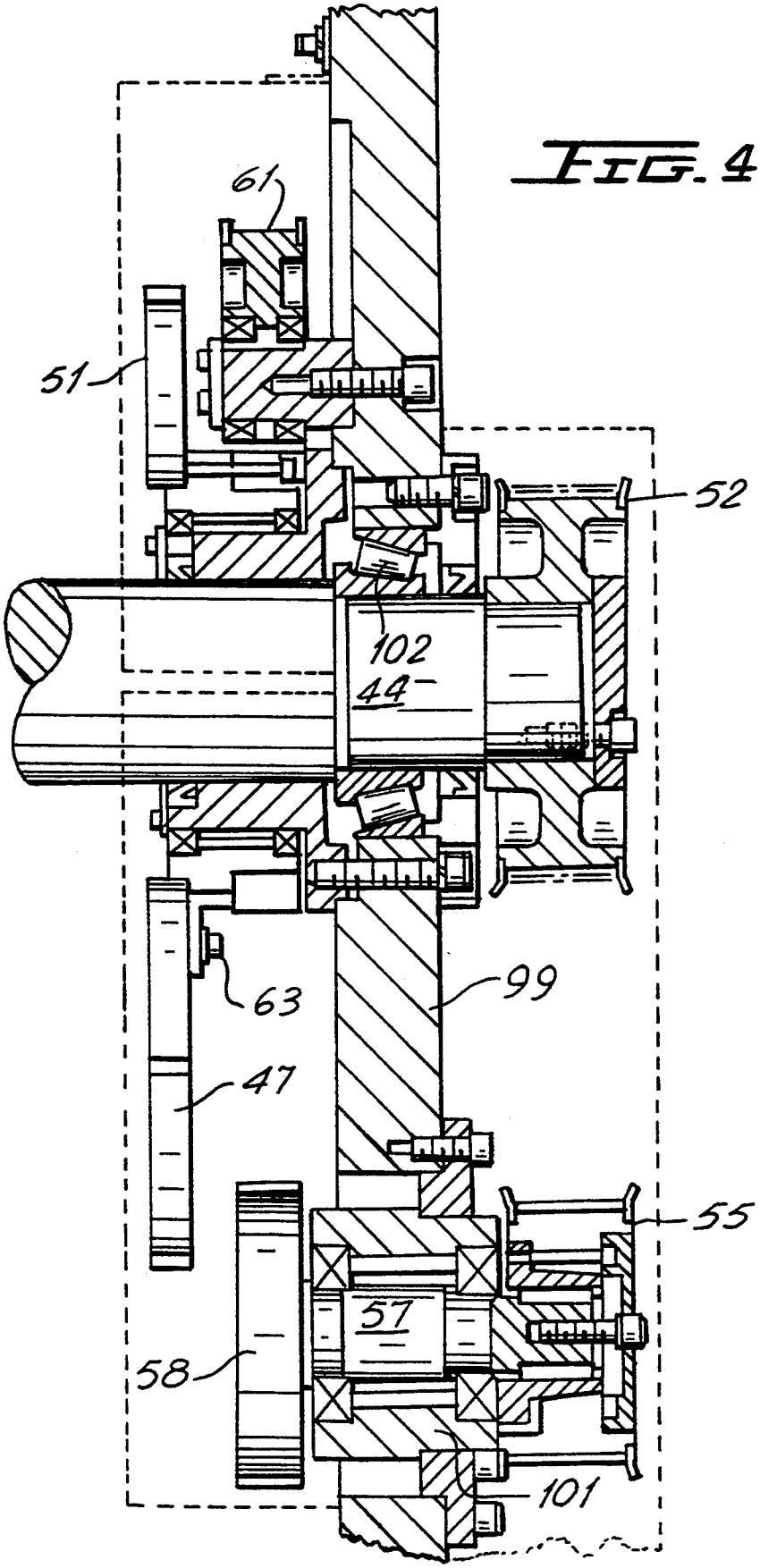
FIG. 4 is a fragmentary cross-section of the common drive taken through line 4—4 in FIG. 3 looking in the direction of arrows 4—4.

Each cassette 45 is also provided with a drive gear 47 whose teeth are in mesh with the teeth of output gear 51 of common drive 50 that is seen best in FIGS. 2 through 4. All of the drive gears 47, are in engagement with output gear 51, being equally spaced and arranged in a circular array around main shaft 44 as a center. Power for common drive 50 is supplied through main shaft 44 to which blanket wheel 40 is keyed. Also keyed to main shaft 44 is common pulley 52 that drives double sided outboard timing belt 53 along a closed loop path that is defined by idler pulley 54, cross shaft drive pulley 55 and take-up pulley 56, as well as pulley 52. Pulley 55 is keyed to one end of cross shaft 57 that extends through ball bearing unit 101 (FIG. 4) in stationary frame 99 that also supports bearing unit 102 through which main shaft 44 extends. Pulley 58 keyed to the inboard end of cross shaft 57 drives double sided inboard timing belt 60 along a closed path that is defined by idler pulley 59, take-up pulley 61 and driven main pulley 62, as well as pulley 58. Pulley 62 is mounted on main shaft 44 so as to be freely rotatable with respect thereto. Screws 63 secure drive gear 51 to the inboard side of pulley 62 so as to be rotatable in unison therewith about main shaft 44 as a center.

With particular reference to FIGS. 5 through 9 it is seen that each of the direct printing cassettes 45 also includes elongated belt drive gear wheel 66 that is mounted on the inboard end of shaft 67 which extends through side frame 68 and is keyed to input gear 47 on the outboard end of shaft 67. Five closed loop timing belts 71 through 75 are in driving engagement with elongated gear 66 and pass over the curved surface 69 of anvil 46. The closed paths for belts 71 through 75 also include respective idlers 81 through 85 that are adjustably mounted on frame ledge 76 that is transverse to side frame 68. The outward or forward position of anvil surface 69 is set to adjust printing pressure by moving elongated ramp element 86 longitudinally, utilizing adjusting screw 88 that is normally held against rotation by split clamp 141 which is tightened by screw 142. Element 86 includes ramp or wedge surface 143 that extends longitudinally and is inclined with respect to the longitudinal axis of screw 88. Wedge surface 143 slides along oppositely inclined surface 144 of anvil 46, with surface 144 being opposite curved belt supporting surface 69. Thus, as ramp element 86 is moved to the left with respect to FIG. 7 the engagement between inclined surfaces 143 and 144 drives curved surface 69 outward (upward with respect to FIG. 7). This tension belts 71–75 and increases their pressure of engagement with cans 16. In and out movement (down and up with respect to FIG. 7) of anvil 46 is stabilized by fixed radial guides in the form of projection 87 which extends into a guide notch (not shown) in one end of anvil 46, and fixed radial guide notch 146 wherein end 147 of anvil 46 is disposed. Guide projection 87 is parallel to guide notch 146. U-shaped handle 80 secured to side frame 68 is provided to facilitate handling of cassette 45 during mounting and dismounting cassette 45 from blanket wheel 40. Two registration pins 77 are used to locate cassette 45 on blanket wheel 40, and three bolts 78 secure cassette 45 to blanket wheel 40.

In a manner known to the art, belts 71 through 75 of unequal lengths are related by having their lengths equal to an integral number of belt segments, with the segments of all belts 71 through 75 being of equal incremental length. The leading printing plate portion of each belt segment is provided with an embossed auxiliary image (FIG. 11), in this case a raised number. Since main shaft 44 rotates continuously at uniform speed, common drive 50 rotates common drive gear 51 continuously at a uniform speed which in turn drives input gears 47 of all cassettes 45 continuously at uniform speed so that the belt drive gear 66 of each cassette 45 is also driven continuously at uniform speed. The gear ratios are such that for each revolution of blanket wheel 40, each of the belts 71 through 75 advances by a distance equal to one incremental length. This means that after one auxiliary image is printed, belt advancement is such that the next auxiliary image on that belt is printed during the next revolution of blanket wheel 40.

Now referring to FIG. 10 for further explanation of the manner in which printing occurs. In FIG. 10 two segments 43*a*, 43*b* of blanket wheel 40 are shown. They are almost completely covered by respective blanket segments 21*a*, 21*b*. Rather than going through an unnecessarily repetitive operational description, in FIG. 10 the entire main image is illustrated as being formed by a single plate 97. The latter is mounted on plate roll 96 which is part of inker unit 32*a* having red ink. Ink (in this case black) is applied to belts 71–75 of the direct printing cassette 45 by plate 95 on plate roll 94. The remaining elements of the most downstream inker unit that includes plate roll 94 are not shown. Inker unit 32 for inking the direct image is more downstream than all of the inker units 32*a*, etc. for inking segments of the main image.

With blanket wheel 40 rotating in the direction indicated by arrow A, when blanket segment 21*b* moves past plate roll 96 the main image (illustrated as being red) is applied to blanket segment 21*b*. For reasons to be explained hereinafter, this main image includes five windows 91, upstream extension 89 and lead edge notch 87. When cassette 45 moves past plate roll 94 ink was applied by printing plate 95 to that auxiliary indicia which is, at that time, being supported by anvil 46. With further movement of blanket wheel segment 43*b* downstream, an undecorated can 16, freely rotatable about its axis on mandrel 20, is engaged initially by the uninked lead portion of blanket segment 21*b* and by the time can 16 engages an inked portion of blanket segment 21*b* the outer cylindrical surface of can 16 is moving at the same linear speed that blanket segment 21*b* is moving. When can 16 is engaged by the belts 71 through 75 of cassette 45, the uninked portions of the can 16, attributable to windows 91, are aligned with the auxiliary images that are supported by anvil 46 and these auxiliary images are applied to can 16. During this time, can 16 is engaged by the upstream extension 89 of blanket segment 21*b* which imparts positive rotational movement to can 16. The inked on extension 89 fills in the uninked notch 87 at the downstream end of the main image on blanket segment 21*b*. There is a substantial gap between the free upstream end of extension 89 of blanket segment 21*b* and the leading edge of blanket segment 21*a*. The gear ratios are such that during printing of the auxiliary images there is a slight difference between the linear speeds of the outer cylindrical surface of can 16 and the portions of belts 71 through 75 that are engaged with can 16.

In a typical can decorating apparatus of the type hereinbefore described blanket wheel 40 is 30 inches in diameter and is divided into 6 segments 43. Cassette belts 71 through 75 are of different lengths having between 19 and 25 end to end segments each 0.75 inch long and having an auxiliary image measuring approximately 0.375 inch along the direction of belt travel. While decorations are being applied to can 16, belts 71 through 75 move along their closed loop paths at a linear speed that is approximately 3% greater than the linear speed of the outer surface of can 16.

While this invention has been described in connection with an embodiment wherein mechanical drive elements, some of which are timing belts, interconnects the offset printing blanket wheel 40 and the direct printing cassettes 45 for coordinated operation over an extended speed range, it should now be apparent to those skilled in the art that a mechanical drive consisting solely of a single gear train (not shown) may be utilized as a direct driving connection between main shaft 44 and common gear 51. It should also now be apparent to those skilled in the art that operation of the blanket wheel 40 and direct printing cassettes 45 may be coordinated by utilizing electrically controlled motors.

Further, while direct printing cassettes 45 have been described as having a plurality of narrow printing belts in order to achieve so-called random numbering, it should now be apparent to one skilled in the art that these narrow belts may be replaced by a single relatively wide belt that prints a single different image for each revolution of the blanket wheel.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. Continuous motion apparatus for decorating cylindrical containers, said apparatus including:

a continuously rotating mandrel carrier having a plurality of rotatable container carrying mandrels positioned along its periphery;

a continuously rotating blanket wheel having its periphery adjacent the periphery of the mandrel carrier;

a plurality of blanket segments having outer arcuate surfaces on said blanket wheel disposed along the periphery thereof, and mounted so that during rotation of said blanket wheel all of said blanket segments remain fixed relative to each other;

a plurality of printing cylinders adjacent the periphery of the blanket wheel;

inking means for applying ink to each of said printing cylinders which in turn apply picture segments to each of said blanket segments on said outer arcuate surfaces to form a complete main image on each of said arcuate surfaces for transfer to an outer cylindrical surface of a container mounted on one of said mandrels, which container is in rolling engagement with said blanket segment as it passes through a printing zone;

an individual direct printing unit associated with an individual one of each of said blanket segments;

each of said direct printing units including a printing means that prints an auxiliary image directly on said cylindrical surfaces as the containers while still on said mandrels pass through the printing zone;

additional inking means for applying ink to the printing means of said direct printing units;

said printing means also including a closed loop flexible belt means having a plurality of printing plate segments disposed in tandem along the length thereof, guide means for directing said flexible belt means along a closed loop path, said guide means including a rotatable drive roll and an anvil disposed behind an individual plate segment to support the individual plate segment in a printing position while the individual plate segment is applying the auxiliary image to the container, and means for operating said drive roll continuously at uniform rotational speed about its own axis during each revolution of said blanket wheel to move said belt means with respect to said anvil by an incremental distance during each revolution of said blanket wheel, said incremental distance being such that a plate segment which is supported by said anvil and has applied an auxiliary image to said outer cylindrical surface of the container continues to move along said closed loop path with respect to said anvil and is replaced in said printing position by the next upstream plate segment;

means for coordinating rotation of said mandrel carrier with rotation of said blanket wheel in a manner such that while said main image is being applied to the outer cylindrical surface, said outer cylindrical surface and said blanket segment are traveling essentially at the same linear speed; and means for coordinating movement of said belt means along said closed loop path with rotation of said mandrels about their respective axes in a manner such that while said auxiliary image is being applied to said outer cylindrical surface, the outer cylindrical surface and said plate segment are traveling at different linear speeds.

2. Continuous motion container decorating apparatus as set forth in claim 1 wherein during application of said main image to said outer cylindrical surface, linear speed of the outer cylindrical surface bears a predetermined ratio with respect to linear speed of said outer arcuate surface; and during application of said auxiliary image to said outer cylindrical surface, linear speed of the outer cylindrical surface is also at said predetermined ratio with respect to linear speed of said outer arcuate surface.

3. Continuous motion container decorating apparatus as set forth in claim 1 in which the additional inking means is downstream of said inking means in direction of travel for said blanket segments so that, for each revolution of said blanket wheel said individual one of said blanket segments is inked prior to inking of the direct printing unit that is associated with the blanket segment that has been inked.

4. Continuous motion container decorating apparatus as set forth in claim 3 wherein during application of said main image to said outer cylindrical surface, linear speed of the outer cylindrical surface bears a predetermined ratio with respect to linear speed of said outer arcuate surface; and during application of said auxiliary image to said outer cylindrical surface, linear speed of the outer cylindrical surface is also at said predetermined ratio with respect to linear speed of said outer arcuate surface.

5. Continuous motion container decorating apparatus as set forth in claim 1 in which:

said blanket wheel being mounted for rotation on a main axis;

each of said direct printing units having an input gear through which power is applied to rotate said drive roll;

drive means providing a mechanical driving connection between said blanket wheel and said printing units;

said drive means having an output gear mounted for rotation on said main axis;

each of said input gears being in mesh with said output gear.

6. Continuous motion container decorating apparatus as set forth in claim 5 in which the additional inking means is downstream of said inking means in direction of travel for said blanket segments so that, for each revolution of said blanket wheel said individual one of said blanket segments is inked prior to inking of the direct printing unit that is associated with the blanket segment that has been inked.

7. Continuous motion container decorating apparatus as set forth in claim 1 in which each of said direct printing units also includes adjusting means for moving said anvil forward and rearward with respect to said plate segment that is being supported thereby from behind; and guide means limiting said anvil to movement that is forward and rearward.

8. Continuous motion container decorating apparatus as set forth in claim 7 in which each of said adjusting means includes a single adjusting screw.

9. Continuous motion container decorating apparatus as set forth in claim 8 in which the blanket wheel rotates on an axis of rotation and said adjusting screw extends parallel to said axis of rotation.

10. Continuous motion container decorating apparatus as set forth in claim 9 in which the adjusting means includes a ramp member mounted on said adjusting screw for adjusting movement parallel to said axis of rotation as said screw is rotated.

11. Continuous motion container decorating apparatus as set forth in claim 10 in which the ramp member includes a forward facing surface that is in sliding engagement with a rearward facing surface on said anvil; said forward and rearward facing surfaces mating along an interface that is inclined with respect to said screw.

12. A method of decorating an outer cylindrical surface of a container, said method including the steps of:

a) utilizing a blanket segment that is along a peripheral edge of a blanket wheel rotating continuously on a main axis to apply a main image on the outer cylindrical surface;

b) utilizing a printing plate portion of a belt means mounted on said blanket wheel and moving continuously in a closed loop path relative to said blanket wheel to apply an auxiliary image on the outer cylindrical surface;

c) rotating said container about its cylindrical axis at a first angular speed while applying said main image to said outer cylindrical surface and rotating said container at said first angular speed while applying said auxiliary image to said outer cylindrical surface;

d) revolving said container about said main axis at a second angular speed while applying said main images to said outer cylindrical surface and revolving said container about said main axis at said second angular speed while applying said auxiliary image to said outer cylindrical surface;

e) moving said outer cylindrical surface and said blanket segment at the same linear speed while said main image is being applied to said outer cylindrical surface;

f) maintaining a differential speed between said outer cylindrical surface and said printing plate portion while the printing plate portion engages the outer cylindrical surface and applies said auxiliary image thereon.

13. A method for decorating containers as set forth in claim 12 in which the main image is applied to the outer cylindrical surface before the auxiliary image is applied to the outer cylindrical surface.

* * * * *